United States Patent [19]

Sheratte

[11] 3,984,340

[45] *Oct. 5, 1976

[54] FUNCTIONAL FLUID COMPOSITIONS CONTAINING EPOXY COMPOUNDS

[75] Inventor: Martin B. Sheratte, Reseda, Calif.

[73] Assignee: McDonnell Douglas Corporation, Long Beach, Calif.

[ * ] Notice: The portion of the term of this patent subsequent to Jan. 27, 1993, has been disclaimed.

[22] Filed: May 20, 1974

[21] Appl. No.: 471,463

Related U.S. Application Data

[63] Continuation-in-part of Ser. No. 400,130, Sept. 24, 1973, and a continuation-in-part of Ser. No. 449,623, Jan. 11, 1974, Pat. No. 3,935,116.

[52] U.S. Cl. ..... 252/78.5; 252/49.8

[51] Int. Cl.[2] ..... C10M 3/40

[58] Field of Search ..... 252/73, 78, 79, 49.8; 260/348 C

[56] References Cited

UNITED STATES PATENTS

| | | | |
|---|---|---|---|
| 2,549,270 | 4/1951 | Watson | 252/78 |
| 2,566,623 | 9/1951 | Moreton | 252/78 |
| 2,636,861 | 4/1953 | Watson | 252/78 |
| 2,659,699 | 11/1953 | George et al. | 252/78 |
| 2,853,498 | 9/1958 | Phillips et al. | 260/348 C |
| 2,853,499 | 9/1958 | Phillips et al. | 260/348 C |
| 3,637,507 | 1/1972 | Gentit | 252/78 |
| 3,723,320 | 3/1973 | Herber et al. | 252/78 |
| 3,783,132 | 1/1974 | Herber | 252/78 |

*Primary Examiner*—Harris A. Pitlick
*Attorney, Agent, or Firm*—Max Geldin

[57] ABSTRACT

A functional fluid composition consisting essentially of (1) a phosphate ester containing at least two alkyl groups such as tributyl phosphate or dibutyl phenyl phosphate, in combination with a phosphate ester containing at least two aromatic groups, such as n-butyl diphenyl phosphate or tricresyl phosphate, (2) a combination of at least two polyalkylene glycol materials, e.g. two polypropylene glycol ethers having substantially different molecular weights, and (3) a small amount of an epoxide, in the form of an ester or polyester of 4,5-epoxy-1,2-cyclohexane dicarboxylic acid, e.g., poly(ethylene-$\Delta^4$-epoxy tetrahydrophthalate), such epoxide preventing acid build-up in the fluid, and preventing undesirable deposits particularly when such fluid is employed as an aircraft hydraulic fluid.

31 Claims, No Drawings

FUNCTIONAL FLUID COMPOSITIONS CONTAINING EPOXY COMPOUNDS

This application is a continuation-in-part of my copending application Ser. No. 400,130, filed Sept. 24, 1973, and Ser. No. 449,623, filed Mar. 11, 1974 and now U.S. Pat. No. 3,935,116.

BACKGROUND OF THE INVENTION

The present invention relates to functional fluid compositions having good fire resistance and desirable viscosity characteristics at both high and low temperature, and is particularly directed to functional fluid compositions consisting essentially of certain combinations of phosphate esters and certain combinations of polyalkylene glycol materials, and an epoxide compound of a type which in conjunction with such glycol materials prevents formation of harmful insoluble deposits and prevents acid build-up in the fluid.

Many different types of materials are employed as functional fluids, and functional fluids are utilized in a wide variety of applications. Thus, such fluids have been utilized as electronic coolants, diffusion pump fluids, lubricants, damping fluid, power transmission and hydraulic fluids, heat transfer fluids and heat pump fluids. A particularly important application of such functional fluids has been their utilization as hydraulic fluids and lubricants in aircraft, requiring successful operation of such fluids over a wide temperature range, and fire resistant fluids.

Functional and hydraulic fluids employed in many industrial applications and particularly hydraulic fluids for aircraft must meet a number of important requirements. Thus, such hydraulic fluids particularly for aircraft use, should be operable over a wide temperature range, should have good stability at relatively high temperatures and preferably have lubricating characteristics. In addition to having the usual combination of properties making it a good lubricant or hydraulic fluid, such fluid should also have relatively low viscosity at extremely low temperatures and an adequately high viscosity at relatively high temperatures, and must have adequate stability at the high operating temperatures of use. Further, it is of importance that such fluids be compatible with and not adversely affect materials including metals and non-metals such as seals of the system in which the fluid is employed. It is also important in aircraft hydraulic fluids and lubricants that such fluids have as high a fire resistance as possible to prevent ignition if such fluids are accidentally or as result of damage to the hydraulic system, sprayed onto or into contact with surfaces of materials of high temperature. Another important property for application of a hydraulic fluid in aircraft is the provision of a low density fluid to increase pay load.

Hydraulic fluids in commercial jet aircraft are exposed to temperatures ranging from below −40° F. to over 200° F. Within these temperature extremes, it is necessary for the fluid to maintain a reasonably low viscosity when cold, and yet not become too thin when hot.

In presently available commercial functional or hydraulic fluids, phosphate esters are among the most commonly employed base stocks, of which tributyl phosphate and dibutyl phenyl phosphate are widely used components. Both of the latter phosphates are too thin at high temperatures, and their use alone would result in rapid wear of moving parts. Other phosphate esters, such as tricresyl phosphate, for example, which provide the requisite high temperature viscosity become too thick to be useful at low temperatures. Even mixtures of various phosphate esters such as those notes above do not provide the required viscosity characteristics at both low and high temperatures. Accordingly, it has been the practice to achieve the required wide viscosity range required for aircraft hydraulic fluids by adding to a thin base stock, such as phosphate ester or mixtures thereof, a small proportion, e.g., up to 10%, of a polymeric material such as polyalkyl acrylates or methacrylates, whose solubility characteristics in the base stock are chosen so that the polymeric material thickens the fluid more at high temperatures than at low temperatures, and thus functions as a viscosity index (VI) improver.

However, during use, fluids of the above type containing polymers such as the polyalkyl acrylates or methacrylates, tend to decompose due to the shearing forces of the mechanical components encountered in an aircraft hydraulic system, on the fluid, and producing acids. This results in a high degree of acid build-up during use, which is detrimental in causing corrosion of metal surfaces with which the fluid is in contact and also causes further decomposition of the fluid.

In U.S. Pat. No. 3,637,507, improved acid stability of such functional or hydraulic fluids is achieved by the addition of monoepoxides and particularly certain diepoxides to hydraulic fluids containing a phosphate ester and particularly polymethacrylate and polyacrylate viscosity index improver. However, in currently manufactured fluids of this type, the functionality of the epoxide is severely limited by the reaction which epoxides can have with acrylate and methacrylate viscosity index improver. Thus, although diepoxides such as the 3,4-epoxycyclohexylmethyl 3,4-epoxycyclohexane carboxylate disclosed in the above patent are preferred over the monoepoxide in the above fluids, the concentration of the latter diepoxide must be kept low since the reaction of polyfunctional epoxides with acrylate and methacrylate type viscosity index improvers leads to the formation of harmful insoluble deposits. Thus, it is particularly noteworthy that in all of the examples of the above patent, and employing polyalkyl methacrylate viscosity index improver, the concentration of the epoxide component, including the above-noted preferred diepoxide of the patent, is employed in a concentration ranging only from about 0.5 to about 1%. The necessity for using such low concentrations of such diepoxides in order to avoid formation of undesirable deposits in the fluid, due to reaction with acrylate and methacrylate viscosity index improvers, limits the effectiveness of such epoxides in preventing acid build-up.

In my copending application Ser. No. 400,130, there is disclosed novel epoxides, particularly polyepoxides, and functional fluid compositions containing such epoxides, said fluid compositions having good fire resistance and desirable viscosity characteristics at both high and low temperatures, and particularly directed to functional fluid compositions having the above-noted properties and consisting essentially of a phosphorus compound, especially a phosphate ester, a polyglycol or a polyglycol ether, and an epoxide from a class of polyepoxides which are esters or polyesters of 4,5-epoxy-1,2-cyclohexane dicarboxylic acid, otherwise termed herein esters or polyesters of $\Delta^4$-epoxy tetrahydrophthalic acid or $\Delta^4$-epoxy tetrahydrophthalate esters or polyesters. Such epoxide can be employed in relatively high concentration to effectively prevent formation of harmful insoluble deposits in the fluid while effectively functioning as an acid absorber to prevent acid build-up, and does not adversely affect the viscosity characteristics of the fluid.

DESCRIPTION OF THE INVENTION

According to the present invention, it has not been found that the above epoxides, particularly polyepoxides having high epoxide funtionality, of my copending application Ser. No. 400,130, can be effectively employed in minor amount as acid absorbers in functional or hydraulic fluids, employing particularly a combination of certain phosphorus esters and a combination of certain glycol materials, as defined hereinafter, to prevent precipitation of harmful deposits in the fluid, while at the same time having substantially less adverse affect upon the viscosity characteristics of the fluid, as compared to certain prior art epoxides, such as epoxidized oils, for example, epoxidized soya bean and tall oils, and epoxy novolacs.

The above-noted epoxides or esters are effective particularly when employed in combination with certain mixtures of polyglycols or polyglycol ethers, having different molecular weights, and permitting use of relatively high concentrations of the epoxide or polyepoxide, in such fluid for effective control of any acid formed in the fluid, and consequently controlling or preventing precipitation of any harmful deposits as result of decomposition of the fluid by the presence of such acid. Thus, relatively high concentrations of the epoxides hereof having relatively low viscosity can be employed in phosphate ester-based functional fluids containing certain combinations of glycol materials, as described hereinafter, to prevent acid build-up and formation of deposits in the fluid containing such glycol materials.

The use as an essential base stock component of a phosphate ester containing at least two aromatic groups, and selected from the class consisting of aryl and alkaryl groups, e.g. diphenyl-n-butyl phosphate, hereinafter termed an "aromatic" phosphate, in combination with a phosphate ester containing at least two aliphatic groups, and selected from the class consisting of alkyl and alkoxyalkyl, e.g. tributyl phosphate or di-n-butyl phenyl phosphate, hereinafter termed an "aliphatic" phosphate, each particularly in certain amounts noted below, is of particular advantage. In the first place, the presence of the phosphate ester containing at least two aromatic groups has been found unexpectedly to increase or improve the AIT (autoignition temperature) characteristics of the resulting fluid or blend, over the fluid having only a phosphate ester or esters containing at least two alkyl groups, that is, the aliphatic phosphate. This advantage renders unnecessary the use of heavy metal, e.g. selenium or lead, or iodine, organic compounds as AIT enhancers. This is particularly noticeable in blends containing an aliphatic phosphate and including polyglycol ethers such as polyethylene glycol or polypropylene glycol mono- or di-butyl ethers. Such blends generally exhibit AIT values below 700° F. in the absence of either selenium additives, or aromatic phosphates. Thus, in a functional fluid containing e.g. about 75% tributyl phosphate, and about 25% polyalkylene glycol material, by replacing a portion of such tributyl phosphate, e.g. 25% by weight of the fluid, with diphenyl octyl phosphate, the AIT of the resulting blend can be raised as much as 100° F. or more the fluid containing only the tributyl phosphate.

A further unexpected advantage of the presence of the aromatic phosphate together with the aliphatic phosphate is a marked decrease in the effect of such fluid blend on non-metallic materials, particularly elastomers such as rubber, as compared to fluids containing only an aliphatic phosphate or phosphates. Thus, the amount of rubber swell occurring on contact of such fluid blend of aromatic and aliphatic phosphates with rubber materials such as rubber seals, is markedly reduced as contrasted to the amount of rubber swell produced by contact with fluids containing only aliphatic phosphates. Hence the presence of such aromatic phosphates in the above fluid blends causes a significant improvement in rubber compatibility. This is quite remarkable, since it is known, as pointed out in U.S. Pat. No. 2,469,285 to White, that aromatic compounds are noted for their capacity to cause rubber swelling.

However, the presence of aromatic phosphates, such as tricresyl phosphate, in blends together with an aliphatic phosphate, such as tributyl phosphate causes the blend to be less responsive to the viscosity improving characteristics of the polyalkylene glycol component. Thus, it has been found advantageous to incorporate at least two different polyalkylene glycol components, that is at least two polyalkylene glycol materials, preferably at least two polyalkylene glycol ethers, that is, monoethers and/or diethers, having substantially different molecular weights, in the fluid or blend containing both the above-noted aromatic and aliphatic phosphates. The result is that the fluid blend can be more readily designed or tailored so that it has the above-noted desirable low and high temperature viscosity characteristics.

Thus, the functional fluids produced according to the invention can be blended as noted above to have a fire resistance greater than the fire resistance of presently employed commercially available hydraulic fluids, and at the same time to have suitably low viscosity at temperatures below −40° F., and down to −65° F., and suitably high viscosity at high temperature of 210° F., and above, and this can be accomplished without incorporating any additional viscosity index improver. By avoiding the necessity for additional viscosity index improver, the functional fluids of the invention do not suffer from the disadvantage noted above, namely, the deterioration of such polymeric additives, e.g. polymeric acrylates or methacrylates, used for viscosity improvement, and accumulation of molecular debris, leading to a shortening of the useful life of the fluid. Hence the functional fluids of the present invention have a longer period of usefulness, providing economic advantages including the avoidance of the high cost of such viscosity index improver and the employment of relatively low cost polyalkylene glycol ethers or diethers, in place of a substantial portion of the phosphate ester generally employed in presently available phosphate based aircraft hydraulic fluids.

Also, the functional fluid compositions and blends of the present invention have improved thermal and hydrolytic stability compared with the phosphate ester based fluids currently in use, contributing to a long useful life for the fluid. In addition, the functional fluids according to the present invention have low densities of the order of 1.0 or less, an important property for aircraft hydraulic fluids. The above advantages can be achieved while at the same time improving the flammability characteristics over phosphate ester-type hydraulic fluids currently in use. Also, the functional fluids according to the invention have freedom from corrosivity, wear and deterioration with respect to the metallic and non-metallic components, and the pumps of hydraulic fluid systems, which compare favorably with these characteristics for phosphate type base stock hydraulic fluids presently commercially employed.

Further, in addition to their valuable application as hydraulic fluids for aircraft hydraulic systems, the fluids according to the invention have important application as a hydraulic of functional fluid in industrial and marine fields, particularly in industrial turbine systems.

The aliphatic phosphate ester employed in the functional fluid according to the invention has the general formula:

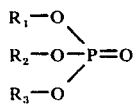

where $R_1$ and $R_2$ each are alkyl, both straight chain and branched chain of from about 3 to about 10 carbon atoms such as n-propyl, n-butyl, n-amyl, n-hexyl, isopropyl, isobutyl, and the like, and alkoxyalkyl having from about 3 to about 8 carbon atoms such as methoxy methyl, methoxy ethyl, ethoxy ethyl, methoxy propyl, and the like, and $R_3$ can be alkyl or alkoxyalkyl as defined above, or aryl such as phenyl and naphthyl, alkaryl such as cresyl, xylyl, ethyl phenyl, propyl phenyl, isopropyl phenyl, and the like, said aryl and alkaryl radicals preferably containing from 6 to about 8 carbon atoms.

Examples of such aliphatic phosphates are the trialkyl phosphates having alkyl groups which are either straight chain or branched chain with from about 3 to about 10 carbon atoms, such as n-propyl, n-butyl, n-amyl and n-hexyl, particularly tri-n-butyl phosphate, tri(2-ethyl hexyl) phosphate and triisononyl phosphate, the straight chain alkyl groups preferably containing from 4 to 6 atoms.

Other examples of such aliphatic phosphate esters are the dialkyl aryl phosphates in which the alkyl groups are either straight chain or branched chain and contain from about 3 to about 10 carbon atoms, such as n-propyl, n-butyl, n-amyl, n-hexyl, isopropyl, isobutyl, isoamyl, and the aryl radicals have from 6 to 8 carbon atoms and can be phenyl, cresyl or xylyl, particularly dialkyl phenyl phosphates including dibutyl phenyl phosphate, butyl amyl phenyl phosphate, butyl hexyl phenyl phosphate, butyl heptyl phenyl phosphate, butyl octyl phenyl phosphate, diamyl phenyl phosphate, amyl hexyl phenyl phosphate, amyl heptyl phenyl phosphate, and dihexyl phenyl phosphate.

The second phosphate ester employed in combination with the above aliphatic phosphate, is an aromatic phosphate. Such aromatic phosphate has the general formula:

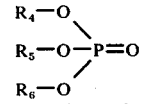

where $R_4$ and $R_5$ are each aryl or alkaryl as defined above, and $R_6$ can be aryl or aralkyl, or alkyl or alkoxyalkyl, as defined above, except that such alkyl can contain from about 3 to about 20 carbon atoms, as illustrated below.

Examples of such aromatic phosphates are triaryl phosphates in which the aryl radicals of such phosphates have from 6 to 8 carbon atoms, that is, may be phenyl, cresyl or xylyl, and in which the total number of carbon atoms in all three of the aryl radicals is from 18 to 24, and preferably wherein the three radicals include at least one cresyl or xylyl radical. Examples of such phosphates include triphenyl, tricresyl, trixylyl, phenyl dicresyl, and cresyl diphenyl phosphates.

Examples of other phosphates also termed herein aromatic phosphates are alkyl diaryl phosphates in which the aryl radicals of such phosphates may have from 6 to 8 carbon atoms and may be phenyl, cresyl, or xylyl, and the alkyl radical may have from about 3 to about 20 carbon atoms, examples of which are given above. Examples of the alkyl diaryl phosphates include butyl diphenyl, amyl diphenyl, hexyl diphenyl, heptyl diphenyl, octyl diphenyl, 6-methyl heptyl diphenyl, 2-ethylhexyl diphenyl, decyl diphenyl, decyl dicresyl, tridecyl diphenyl, butyl phenyl cresyl, amyl phenyl xylyl, and butyl dicresyl phosphates.

The above aliphatic and aromatic phosphate esters which can be employed generally are normally liquid between about −65° F. and 210° F., except for triphenyl phosphate. Preferably, the above-noted trialkyl phosphates such as tributyl phosphate or tri-n-hexyl phosphate are employed as the basic aliphatic phosphate, as such phosphates are particularly effective in achieving low viscosity at low temperature. However, the above-noted dialkyl aryl phosphates such as dibutyl phenyl phosphate, also can be employed as the aliphatic phosphate, and such phosphate can be employed in combination with a trialkyl phosphate such as tributyl phosphate.

The aromatic phosphate preferably employed in combination with the aliphatic phosphate component in formulating the above-noted blends, are triaryl phosphates as illustrated above, e.g. tricresyl phosphate, particularly in combination with the above-noted trialkyl phosphates, e.g. tributyl phosphate. However, the above-noted alkyl diaryl phosphate such as butyl diphenyl phosphate or octyl diphenyl phosphate or tridecyl diphenyl phosphate also can be employed, particularly in combination with the above-noted trialkyl phosphate. Mixtures of aromatic phosphates also can be employed as the aromatic phosphate ester component.

Further, a mixture of three of the above aliphatic and aromatic phosphates can be used, e.g. a mixture of dibutyl phenyl, tributyl and triphenyl phosphates, or a mixture of tributyl, trihexyl and butyl diphenyl phosphates. Since triphenyl phosphate is a solid at ambient temperature, it is generally employed in combination with a liquid aliphatic phosphate in sufficient amount to maintain the combination liquid over the desired temperature range of operation of the fluid.

The second essential component of the functional fluid according to the invention is a polyalkylene glycol material. The polyalkylene glycol materials employed are compatible with the above-noted phosphate esters.

Although polyalkylene glycols, e.g. polypropylene glycol, can be employed, the preferred polyalkylene glycol materials are those in which one or both of the terminal hydroxy groups have been modified to form ether groups, providing mono- or diether derivatives, or combinations thereof. Thus, the most desirable glycol materials for purposes of the invention are the monoethers and diethers. Particularly satisfactory materials have been found to be the monomethyl ether of polypropylene glycol, the copolymer of ethylene oxide and propylene oxide, monobutyl ether, and the butyl, methyl diether of polypropylene glycol.

The polyalkylene glycol materials employed in the invention composition preferably are substantially hydrophobic materials. It is preferred not to employ those polyalkylene glycol materials that are to any significant extent water miscible and which would accordingly tend to dissolve water at one temperature and crystallize water out at lower temperatures. The molecular weight of the glycol materials can range from about 500 to about 25,000. Also, it is desirable that the polyalkylene glycol component employed be of a type which tends to supercool and to maintain a low viscosity at temperatures down to about −65° F.

However, as previously noted, it has been found advantageous to incorporate two or more glycol materials of the types described above, in combination with a blend of aromatic and aliphatic phosphates, such glycol materials having substantially different molecular weights. Thus, it has been found most desirable to employ a combination of a glycol material preferably an ether, having a low to medium molecular weight, ranging from about 500 to about 2,000, preferably from about 600 to about 1,200, in order to maintain as low a viscosity of the functional fluid as possible at low temperatures, with a high molecular weight glycol material, preferably an ether, the latter material having a molecular weight above about 2,000, generally ranging from about 3,000 to about 25,000.

The ether end groups which preferably are present on the polyalkylene glycol materials are preferably oxyalkyl groups, the alkyl radicals of which can range from 1 to about 8 carbon atoms in length. The longer chain alkyl groups having in excess of 4 carbon atoms, e.g. pentyl, hexyl, heptyl and octyl, are not preferred because polyalkylene glycol ethers of this type have increased viscosity. It is preferred to employ one or more end alkyl groups in the polyalkylene glycol mono- or diether, which have from 1 to 4 carbon atoms. Thus, preferred end alkyl groups are, for example, methyl, ethyl, n-propyl, isopropyl, n-butyl, isobutyl, and the like. It is often desirable that where a diether is employed, one of the end alkyl groups be a methyl or an ethyl radical, while the other end alkyl group of the diether be, for example, a propyl or butyl radical.

The alkylene groups of the polyalkylene glycol material can be an ethylene or propylene group, or mixtures thereof, that is, copolymers containing ethylene and propylene groups. The propylene polymers and ethylene-propylene copolymers, that is, copolymers of ethylene oxide and propylene oxide, are preferred over the ethylene polymers, because of the increased water solubility of the ethylene polymers.

Particularly satisfactory polyalkylene glycol materials for purposes of the invention are the n-butyl methyl, n-butyl ethyl, isobutyl ethyl, n-propyl ethyl and isopropyl ethyl diethers of polypropylene glycol, the monomethyl ether of polypropylene glycol and the copolymer of ethylene oxide and propylene oxide, monobutyl ether.

The preferred polyalkylene glycol materials employed in the invention composition can be produced in known manner from the 1,2-alkylene glycols. Thus, for example, polypropylene glycol materials are prepared by reacting 1,2-propylene oxide and the corresponding alkylene glycol to form poly-1,2-propylene glycol derivatives, and one or both terminal hydroxy groups can be modified to provide the above-noted ether groups, either during or after polymerization. The term "polypropylene glycol" employed in the specification and claims is intended to denote and include the above-noted poly-1,2-propylene glycol derivatives.

As noted above, mixtures of the above polyalkylene glycol materials, e.g. mixtures of polypropylene glycol mono and/or diethers can be used, or mixtures of two copolymers of ethylene oxide and propylene oxide, monobutyl ether, of substantially different molecular weights.

The phosphate esters are employed in amounts sufficient particularly to provide good fire resistance or flammability characteristics of the functional fluid. Further, the phosphates and glycol materials are present in amounts such that the functional fluid composition has a viscosity at −65° F. of not greater than about 6,000 cs, preferably not greater than about 4,200 cs, and a viscosity at 210° F. of not less than 2.25 cs, preferably not less than about 3.0 cs. Generally, the combination or mixture of phosphate esters is employed in an amount ranging from about 15 to about 90%, preferably about 15 to about 70%, by weight of the functional fluid composition. In the mixture of aliphatic and aromatic phosphates, the aliphatic phosphate can be present in an amount ranging from about 10 to about 80%, preferably about 10 to about 60%, and the aromatic phosphate can be present in an amount ranging from about 5 to about 75%, preferably about 5 to about 40%, by weight of the composition. It has often been found desirable to employ a larger amount of the aliphatic phosphate as compared to aromatic phosphate, e.g. a ratio of from 3:2 to 8:1 of aliphatic to aromatic phosphate. However, in some instances a larger amount of aromatic phosphate to aliphatic phosphate can be employed.

The combination or mixture of polyalkylene glycol materials e.g. polypropylene glycol monoethers or diethers, which can be employed can range from about 10 to about 85%, preferably about 10 to about 70%, by weight of the functional fluid composition. Compositions containing approximately equal weight proportions of the mixture of phosphate esters and the mixture of polyalkylene glycol materials, for example, have been found quite effective. In the mixtures of polyalkylene glycol materials, a low to medium molecular weight glycol material can be used in an amount ranging from about 8% to about 65%, preferably about 10 to about 40%, and a glycol material of high molecular weight in an amount ranging from about 2 to about 25%, preferably about 4 to about 15%, by weight of the composition. In such mixture of glycol materials, generally the polyalkylene glycol material of low to medium molecular weight is employed in larger amount than the glycol material of high molecular weight, e.g. in a ratio of 3:2 to 5:1 of the former to the latter.

In any event, the minimum above-noted proportions of at least 15% of a mixture of phosphate esters, and at least 10% of a mixture of the polyalkylene glycol materials, by weight, are present in the functional fluid.

The description of the above-described phosphate esters and glycol materials is essentially set forth in my above copending application Ser. No. 449,623.

The epoxy compounds or polyesters of 4,5-epoxy-1,2-cyclohexene dicarboxylic acid incorporated into the phosphate ester-glycol material base stock described above, have the following general formula:

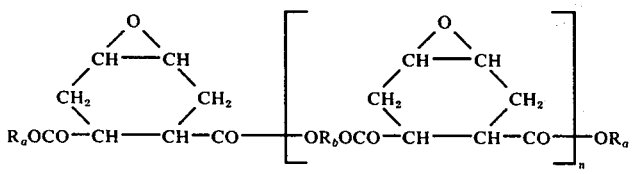

wherein $R_a$ is a monovalent radical selected from the group consisting of alkyl of from 1 to 10 carbon atoms, including methyl, ethyl, propyl, butyl, isobutyl, amyl, isoamyl, pentyl, hexyl, octyl, isooctyl, 2-ethyl butyl, and the like, aryl of from 6 to 9 carbon atoms including phenyl, tolyl, xylyl, and the like, alkoxy alkyl wherein the total number of carbon atoms ranges from 2 to about 10, such as methoxy methyl, ethoxy ethyl, ethoxy propyl, propoxy butyl, butoxy isopropyl, and the like, and substituted aryl such as halogenated aryl of from 6 to 9 carbon atoms, and one or more, e.g., 1 to 3, halogen atoms, e.g., chlorophenyl, bromophenyl, and the like, and $R_b$ is a divalent radical selected from the group consisting of alkylene of from 2 to 4 carbon atoms, including ethylene, propylene and butylene, polyalkylene oxides, the alkylene group thereof containing from 2 to 4 carbon atoms, such as polyethylene oxide, polypropylene oxide and the like, arylene oxides containing from 6 to 15 carbon atoms, including hydroquinone, resorcinol and bisphenol A, and wherein a portion of the $R_b$ radical can be replaced by $R_c$, which is a polyvalent radical of the hydrocarbon portion of a polyhydric alcohol, e.g., a trihydric or tetrahydric alcohol, such as glycerol, pentaerythritol, trimethylolpropane, and the like, and wherein n can range from 1 to about 50, and when such epoxides are employed particularly in hydraulic fluids, n can range from 1 to about 10, and when employed as polyepoxides in such fluids, particularly about 1.5 to about 10.

Molecular weights of the above epoxides can range from about 250 to about 10,000, and for preferred polymers particularly useful for incorporation in functional or hydraulic fluids, the molecular weight ranges from about 500 to about 2,000, corresponding to n ranging from about 1 to about 8. The epoxy equivalency can range generally from about 200 to about 1,000, preferably about 250 to about 300, the epoxy equivalent being defined as the molecular weight per epoxy group.

The polyepoxides or polyesters of the present invention can be prepared, according to one mode of procedure, by condesation of maleic anhydride with a polyol such as ethylene glycol, a chain terminating alcohol such as n-butanol being included in the initial polymerization step to control the size or molecular weight of the desired polyester molecules, treating the so-formed polyester with butadiene to form a polyester of cyclohexene dicarboxylic acid, and finally epoxidizing such cyclohexene ring.

According to an alternative mode of procedure, the polyepoxides employed in the present invention can be prepared by reacting tetrahydrophthalic anhydride with a polyol such as ethylene glycol to form a polyester of cyclohexene dicarboxylic acid, the presence of a chain terminating alcohol such as n-butanol being included in the reaction for controlling chain length, followed by epoxidizing the cyclohexene ring of the polymer.

The above procedures for producing the polyepoxides can be further modified by employment of a polyalkylene glycol in place of ethylene glycol. Such modification can produce epoxy resins which although not advantageous for use in hydraulic fluids, will cure to more flexible solids, the resulting cross-linked solids having advantageous properties such as high impact resistance and high strength at low temperatures, e.g., for use as potting compounds.

A still further modification of the above procedures for producing the polyepoxides is to introduce glycerol, pentaerythritol or other polyols, in place of or in combination with a diol such as ethylene glycol. By appropriate choice of polyglycols and polyols, room temperature curing thermally stable rubbers with properties comparable to those of the polyurethanes may be prepared.

The following are examples of preparation of the novel epoxides or polyesters employed herein.

EXAMPLE 1

A. Poly-(ethylene maleate), butyl ester terminated.

Maleic anhydride (98g, 1.0 Mole) was dissolved in 325 ml hot toluene containing 0.5g p-toluene sulphonic acid. Ethylene glycol (55.8g, 0.9 Mole) was added and the mixture was refluxed while the water evolved was collected in a Dean-Stark apparatus.

After 48 hours, evolution of water stopped when 15.5 cc water had been collected (theoretical 16.2g). At the end of the 48 hours refluxing period, 50 cc n-butanol was added, and the mixture heated under reflux for a further 24 hours, during which time a further 3.2 cc water was collected (theoretical 2.5cc).

The product was washed with 10% sodium bicarbonate solution, and dried over sodium sulphate. Removal of excess solvent left 148g colorless polymer (theoretical 149.6).

B. Butyl ester terminated poly-(ethylene-tetrahydrophthalate)

The above product, butyl ester terminated poly-(ethylene-maleate) (15g) was dissolved in toluene, and heated under reflux for 6 hours while butadiene was bubbled through the solution. At the end of this time, absorption of the butadiene had stopped. The solution was cooled and the toluene was vacuum stripped, leaving 20.2g polymer (theoretical 20.3g).

C. Poly-(ethylene-$\Delta^4$-epoxy tetrahydrophthalate)

The above polyester (20g) was dissolved in 100cc chloroform and epoxidized by treatment with 20g monoperphthalic acid (10% excess) at room temperature for 24 hours. The epoxidized solution was filtered from precipitated phthalic acid and extracted with sodium carbonate solution to remove excess monoperphthalic acid. After drying the chloroform was removed to yield 21g of a pale yellow oil (theoretical yield 21.7g). The oil had an epoxide equivalent of 260, indicating almost complete epoxidation.

EXAMPLE 2

A. Poly-(ethylene-tetrahydrophthalate) butyl ester terminated

Cis-tetrahydrophthalic anhydride (30.4g, 0.2 Mole) was dissolved in 125 ml toluene. Ethylene glycol (11.16g, 0.18 Mole) was added, together with 0.2g p-toluene sulphonic acid. The mixture was stirred under reflux for 18 hours, and the water evolved was separated in a Dean-Stark apparatus. (About 3cc water was collected). At the end of this time, an excess (approximately 20cc) of n-butanol was added, and refluxing was continued for a further 24 hours.

The product was washed with dilute sodium carbonate solution, then water and finally dried over sodium sulphate. Removal of the toluene and excess butanol left a colorless oil.

B. Poly-(ethylene-$\Delta^4$-epoxy tetrahydrophthalate)

This was prepared from the above poly-ethylene-tetrahydrophthalate in the same manner as described in Example 1C above.

The polymer or compound prepared according to the above Examples 1 and 2 and designated compound A, has a formula corresponding to the general formula noted above, wherein $R_a$ is $CH_3 - (CH_2)_2CH_2-$ and $R_b$ is $- CH_2 - CH_2 -$, and had a molecular weight of approximately 2,000, indicating a degree of polymerization ($n$ in the general formula) of about 8 units. Longer or shorter chains can be prepared by adjusting the relative proportions of the reactants.

EXAMPLE 3

Preparation of Branched Poly-epoxide

Cis-tetrahydrophthalic anhydride (30.4g, 0.2 Mole) was dissolved in 125 ml toluene. Ethylene glycol (9.92g, 0.16 Mole) and glycerol (1.20g, 0.013 Mole) were added, together with 0.2g p-toluene sulphonic acid. The mixture was stirred under reflux for 18 hours during which time about 3cc of water was collected. At the end of this time, about 20cc n-butanol was added and the refluxing continued for a further 24 hours. 40g stiff oily polymer was recovered, which was epoxidized with monoperphthalic acid dissolved in chloroform as noted above in Example 1C, to form the polyester designated compound B.

Further examples of epoxides employed according to the present invention are as follows, referring to the general formula of the epoxides set forth above:

TABLE 1

| Compound | $R_a$ | $R_b$ | n |
|---|---|---|---|
| C | n-butyl | propylene | 8 |
| D | n-propyl | ethylene | 10 |
| E | ethyl | propylene | 10 |
| F | amyl | ethylene | 6 |
| G | n-propyl | mixed ethylene-dehydroxylated glycerol | 7 |
| H | phenyl | ethylene | 9 |
| I | tolyl | propylene | 5 |
| J | n-propyl | ethylene | 20 |
| K | isopropyl | propylene | 8 |
| L | n-octyl | ethylene | 4 |
| M | n-butyl | mixed ethylene-trimethylol propane | 7 |
| N | methyl | ethylene | 10 |

Preferred polyepoxides according to the invention are those in which $R_a$ is alkyl, particularly alkyl of from about 2 to about 8 carbon atoms, wherein $R_b$ is ethylene or propylene, and wherein $n$ is between 1 and about 10, and between about 1,5 to about 10, especially, and having an epoxy equivalency between about 250 and about 300 and a molecular weight ranging from about 350 to about 2000, particularly for incorporation of such epoxides in functional or hydraulic fluids. Polyepoxides according to the invention which are particularly effective for this purpose are those produced according to Examples 1 and 2 above and having a molecular weight ranging from about 500 to about 2,000.

The epoxy compound or epoxy ester is employed in a small amount, generally ranging from about 0.1 to about 20%, preferably about 2 to about 10%, by weight of the functional fluid composition.

The description of the above-described epoxy compounds is set forth in my above copending application Ser. No. 400,130.

It was found unexpectedly that the epoxides or polyepoxides function effectively to prevent acid buildup and precipitation of harmful deposits in the fluid, especially at high temperatures, without adversely affecting the desirable low and high temperature viscosity characteristics in the presence of both the high molecular weight polyalkylene glycol material and the low to medium molecular weight polyalkylene glycol material, particularly since such glycol materials are employed in substantial proportions as a base stock component. In addition, it was found further unexpectedly that the epoxide or polyepoxide additives hereof effectively function to reduce or prevent acid buildup and harmful deposits without adversely affecting the enhancement of autoignition temperature as result of employing an aromatic phosphate in combination with an aliphatic phosphate. In addition, when the polyepoxides hereof are employed in amounts of at least 3% by weight, they also function as viscosity index improvers in the fluid containing the combination of phosphate esters and the combination of polyalkylene glycol materials.

It will also be understood that other commonly employed additives such as corrosion inhibitors, oxidation inhibitors, stabilizers, metal deactivators, and the like, such as dialkyl sulfides, benzothazole, 1,2-bis(phenylthio) ethane, phenyl alpha naphthylamine and phenolic oxidation inhibitors, well known as functional fluid additives in the art, can also be incorporated in the functional fluid composition of the invention, in relatively small amounts, if desired.

The following are examples illustrating functional fluid compositions according to the invention, incorporating the novel epoxides or polyepoxides of the invention, such examples being only illustrative and are not intended as limitative of the invention.

EXAMPLE 4

The following composition containing a combination of phosphate esters and a combination of polyalkylene glycol ethers was prepared:

Composition AA

| Components | Grams |
|---|---|
| Tributyl phosphate | 495 |
| "Santicizer 148" | 244 |
| Ucon LB 285 | 141 |
| Ucon 50HB 5100 | 56 |
| Bis(phenylthio)-ethane | 4 |
| Water | 2 |
| | 942 |

Santicizer 148 is understood to be a mixed alkyl ($C_8$–$C_{13}$) diphenyl phosphate.

Ucon LB 285 is understood to be the copolymer of ethylene oxide and propylene oxide, monobutyl ether having a molecular weight of approximately 1,000.

Ucon 50HB 5100 is understood to be the copolymer of ethylene oxide and propylene oxide, monobutyl ether, molecular weight 4,000–5,000.

The resulting composition containing a mixture of aliphatic and aromatic phosphates has an AIT (autoignition temperature) of about 800°F.

The fluid composition AA was divided into two aliquot proportions of 100 ml each. To one aliquot was added 6 grams of the copolymer of 4,5-epoxy-1,2-cyclohexane dicarboxylic acid with ethylene glycol, butyl ester terminated, having a molecular weight of about 500, prepared substantially according to Example 1, the latter composition designated BB. The latter fluid BB also had an AIT of about 800°F.

Each of the fluid compositions AA and BB were heated at 300°F. for 5 hours, and the acid number of each was determined after this treatment according to ASTM-D974 standard procedure. The fluid composition AA not containing any epoxide had developed a relatively high acid number in excess of 5, whereas the fluid BB containing the above polyepoxide had an acid number of only 0.6, thereby demonstrating the effectiveness of such polyepoxide in the fluid composition AA, without adversely affecting other properties of such fluid, including enhanced AIT, both fluid compositions also having good high and low temperature viscosity, viscosity at −65°F. for both fluids being of the order of about 3500 centistokes (cs), and viscosity at 210°F. for both fluids being of the order of about 3.0 cs, and both fluids exhibiting minimum rubber swell characteristics.

EXAMPLE 5

The following compositions containing a combination of phosphate esters, a combination of polyalkylene glycol ethers and a polyepoxy ester according to the invention are also illustrative.

| Composition CC | |
|---|---|
| COMPONENTS | Per cent by weight |
| Dibutyl phenyl phosphate | 75.1 |
| Octyl diphenyl phosphate | 2.0 |
| Ucon LB 285 | 10.0 |
| Ucon 50 HB 5100 | 2.0 |
| Poly (ethylene-$\Delta^4$-epoxy tetrahydrophthalate) (mw - approx. 600) | 10.0 |
| 1,2-bis (phenylthio) ethane | 0.5 |
| water | 0.4 |
| | 100.0% |

| Composition DD | |
|---|---|
| COMPONENTS | Per cent by weight |
| Butyl diphenyl phosphate | 8 |
| Tri-n-hexyl phosphate | 55 |
| Ucon DLB-200E | 18 |
| Jeffox OL 2700 | 15.5 |
| Poly (ethylene-$\Delta^4$-epoxy tetrahydrophthalate) (mw - approx. 1,000) | 3.5 |
| | 100.0 |

Ucon DLB-200E is n-butyl-methyl diether of polypropylene glycol (mw. about 1,000). Jeffox OL 2700 is a polypropylene glycol monomethyl ether (mw. about 3,000).

EXAMPLE 6

The following fluids are also illustrative of the functional or hydraulic fluids of the invention, the specific epoxy esters noted in Table 2 below being defined in Table 1 above.

TABLE 2

| Components | COMPOSITIONS (% by weight) | | | | | | | | |
|---|---|---|---|---|---|---|---|---|---|
| | EE | FF | GG | HH | JJ | KK | LL | MM | NN |
| Dibutyl phenyl phosphate | — | — | — | 45 | — | 15 | — | 15 | — |
| Octyl diphenyl phosphate | — | 20 | — | — | 20 | — | — | — | 15 |
| Tributyl phosphate | 50 | 55 | 25 | — | 40 | — | 50 | 30 | 40 |
| Tricresyl phosphate | 20 | — | — | 20 | — | — | 15 | 25 | 20 |
| Butyl diphenyl phosphate | — | — | 25 | — | — | 25 | — | — | — |
| Tri-n-hexyl phosphate | — | — | 25 | — | — | — | — | — | — |
| Ucon 50 HB 5100 | 6 | 6 | — | — | 10 | — | 10 | 5 | — |
| Ucon DLB 62E | — | — | 14 | 23 | — | — | — | — | 15 |
| Jeffox OL 2700 | — | — | 8 | 6 | — | 20 | — | — | 7 |
| Ucon LB 285 | 17 | 15 | — | — | 20 | 36 | 20 | 22 | — |
| Compound C (epoxy ester) | 7 | — | — | — | — | 4 | 5 | — | — |
| Compound D (epoxy ester) | — | 4 | — | — | — | — | — | 3 | — |
| Compound G (epoxy ester) | — | — | 3 | — | — | — | — | — | — |
| Compound I (epoxy ester) | — | — | — | 6 | — | — | — | — | — |
| Compound L (epoxy ester) | — | — | — | — | 10 | — | — | — | 3 |
| | 100 | 100 | 100 | 100 | 100 | 100 | 100 | 100 | 100 |

Ucon DLB 62E is the n-butyl methyl diether of polypropylene glycol (mw. about 700).

EXAMPLE 7

The following is another exemplary functional or hydraulic fluid according to the invention:

| Composition 00 | |
|---|---|
| Tri-n-butyl phosphate | 55 |
| Tricresyl phosphate | 15 |
| Ucon LB 285 | 20 |
| Ucon 50HB 5100 | 7 |
| Compound E | 3 |
| | 100.0 |

It is noted that the novel epoxide or epoxy ester components in Examples 4 to 7 above were employed in relatively high concentration ranging from 3 to 10%, and resulting in maintaining the fluids, containing the combination of phosphate esters and the combination of polyglycol materials clear, with no formation of precipitates or deposits in the fluid.

In addition to their valuable applications as hydraulic fluids for aircraft hydraulic systems, the fluids according to the present invention have important applications as hydraulic functional fluids in industrial and marine fields, particularly in industrial turbine systems.

From the foregoing, it is seen that in accordance with the invention, certain polyepoxide compounds, in the form of esters of 4,5-epoxy-1,2-cyclohexane dicarboxylic acid are particularly valuable as additives in functional fluids designed particularly for use as hydraulic fluids in jet aircraft, such functional fluids being in the form of a mixture of aliphatic and aromatic phosphate esters, a mixture of polyalkalene glycol materials, particularly a mixture of polypropylene glycol ethers of low to medium molecular weight and of high molecular weight, and a small amount of the above-described epoxide, or polyepoxide, compound. The resulting functional or hydraulic fluids have controlled low acidity and absence of deposits harmful to hydraulic fluid system components, and good viscosity characteristics both at low and high temperature, such fluids at the same time having good thermal and hydrolytic stability and high autoignition temperature, and having fire resistance and corrosion and pump wear resistance comparable to conventionally employed phosphate ester hydraulic fluids.

While I have described particular embodiments of my invention for the purpose of illustration within the spirit of the invention, various changes and modifications can be made, and hence it will be understood that the invention is not to be taken as limited except by the scope of the appended claims.

I claim:

1. A functional fluid composition consisting essentially of (1) a combination of at least two phosphate esters, one of said phosphate esters containing at least two groups selected from the class consisting of alkyl and alkoxyalkyl, and mixtures thereof, and a second of said phosphate esters containing at least two aromatic groups selected from the class consisting of aryl and alkaryl groups, and mixtures thereof, (2) a combination of at least two polyalkylene glycol materials having terminal groups selected from the class consisting of free hydroxyl and ether groups, said ether groups being oxyalkyl groups wherein the alkyl radicals contain from 1 to 8 carbon atoms, said alkylene groups being selected from the class consisting of ethylene and propylene radicals, one of said polyalkylene glycol materials having a molecular weight ranging from about 500 to about 2,000, and a second of said polyalkylene glycol materials having a molecular weight ranging from about 2,000 up to about 25,000, said phosphate esters and said polyalkylene glycol ethers being present in amounts such that said composition has a viscosity at −65°F of not greater than about 6,000 centistokes, and a viscosity at 210°F of not less than 2.25 centistokes, and (3) a small amount of an epoxy compound sufficient to prevent precipitation of deposits in said fluid, said epoxy compound having the general formula:

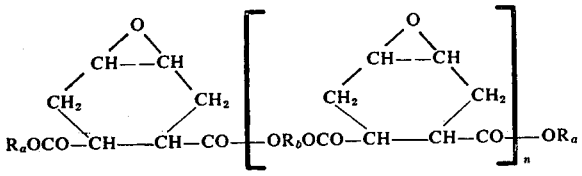

wherein $R_a$ is selected from the group consisting of alkyl of from 1 to 10 carbon atoms, aryl of from 6 to 9 carbon atoms, alkoxy alkyl wherein the total number of carbon atoms ranges from 2 to 10, and halogenated aryl of from 6 to 9 carbon atoms, $R_b$ is selected from the group consisting of alkylene oxides, the alkylene group thereof containing from 2 to 4 carbon atoms, arylene oxides containing from 6 to 15 carbon atoms, and wherein a portion of said $R_b$ radical can be replaced by $R_c$, $R_c$ being a polyvalent radical of the hydrocarbon portion of a polyhydric alcohol selected from the group consisting of trihydric and tetrahydric alcohols, and wherein n can range from 1 to about 50, and having a molecular weight up to about 10,000.

2. A functional fluid composition as defined in claim 1, said phosphate esters and said polyalkylene glycol ethers being present in amounts such that said composition has a viscosity at −65°F. not greater than about 4,200 centistokes and a viscosity at 210°F. not less than about 3.0 centistokes.

3. A functional fluid composition as defined in claim 1, said combination of phosphate esters being present in an amount ranging from about 15 to about 90%, said combination of polyalkylene glycol materials being present in an amount ranging from about 10 to about 85%, and said epoxy compound being present in an amount ranging from about 0.1 to about 20%, by weight of said composition.

4. A functional fluid composition as defined in claim 1, said combination of phosphate esters being present in an amount ranging from about 15 to about 70%, said combination of polyalkylene glycol materials being present in an amount ranging from about 10 to about 70%, and said epoxy compound being present in an amount ranging from about 2 to about 10%, by weight of said composition.

5. A functional fluid composition as defined in claim 1, said one phosphate ester being present in an amount ranging from about 10 to about 80%, and said second phosphate ester being present in an amount ranging from about 5 to about 75%, said one polyalkylene glycol material being present in an amount ranging from about 8 to about 65%, said second polyalkylene glycol material being present in an amount ranging from about 2 to about 25%, by weight of said composition, and said epoxy compound being present in an amount ranging from about 0.1 to about 20%, by weight of said composition.

6. A functional fluid composition as defined in claim 5, said one phosphate ester having the general formula:

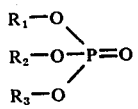

where $R_1$ and $R_2$ are each a member selected from the group consisting of alkyl of from about 3 to about 10 carbon atoms, and alkoxyalkyl having from about 3 to about 8 carbon atoms, and $R_3$ is a member selected from the group consisting of alkyl and alkoxyalkyl, as above defined, aryl and alkaryl, containing from 6 to about 8 carbon atoms, said second phosphate ester having the general formula:

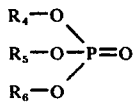

where $R_4$ and $R_5$ are each a member selected from the group consisting of aryl and alkaryl, containing from 6 to about 8 carbon atoms, and $R_6$ is a member selected from the group consisting of aryl and alkaryl, containing from 6 to about 8 carbon atoms, alkyl of from about 3 to about 20 carbon atoms, and alkoxyalkyl having from about 3 to about 8 carbon atoms.

7. A functional composition as defined in claim 6, wherein said one phosphate ester is selected from the group consisting of dialkyl aryl and trialkyl phosphates, and said second phosphate ester is selected from the group consisting of triaryl and alkyl diaryl phosphate.

8. A functional fluid composition as defined in claim 5, said polyalkylene glycol materials each being a polyalkylene glycol ether having at least one terminal oxyalkyl group wherein the alkyl radical contains from 1 to about 8 carbon atoms.

9. A functional fluid composition as defined in claim 5, said polyalkylene glycol materials being selected from the group consisting of a polypropylene glycol mono- or diether, and a mono- or diether of an ethylene-propylene copolymer, said mono- or diethers having at least one terminal oxyalkyl group wherein the alkyl radicals contain from 1 to about 4 carbon atoms.

10. A functional fluid composition as defined in claim 6, said polyalkylene glycol materials being selected from the group consisting of a polypropylene glycol mono- or diether, and a mono- or diether of an ethylene-propylene copolymer, said mono- or diethers having at least one terminal oxyalkyl groups wherein the alkyl radicals contain from 1 to about 4 carbon atoms.

11. A functional fluid composition as defined in claim 10, said one polyalkylene glycol ether having a molecular weight ranging from about 600 to about 1,200, and said second polyalkylene glycol ether having a molecular weight ranging from about 3,000 to about 25,000.

12. A functional composition as defined in claim 11, wherein said one phosphate ester is selected from the group consisting of dialkyl aryl and trialkyl phosphates, and said second phosphate ester is selected from the group consisting of triaryl and alkyl diaryl phosphates.

13. A functional fluid composition as defined in claim 12, said one phosphate ester being present in an amount ranging from about 10 to abut 60%, and said second phosphate ester being present in an amount ranging from about 5 to about 40%, said one polyalkylene glycol ether being present in an amount ranging from about 10 to about 40%, and said second polyalkylene glycol ether being present in an amount ranging from about 4 to about 15%, by weight of said composition, and said epoxy compound being present in an amount ranging from about 2 to about 10%, by weight of said composition.

14. A functional fluid composition as defined in claim 11, said one phosphate ester being selected from the group consisting of tributyl phosphate, dibutyl phenyl phosphate and tri-n-hexyl phosphate, and said second phosphate ester being selected from the group consisting of tricresyl phosphate, butyl diphenyl phosphate, octyl diphenyl phosphate and tridecyl diphenyl phosphate.

15. A functional fluid composition as defined in claim 13, said one phosphate ester being selected from the group consisting of tributyl phosphate, dibutyl phenyl phosphate and tri-n-hexyl phosphate, and said second phosphate ester being selected from the group consisting of tricresyl phosphate, butyl diphenylphosphate, octyl diphenyl phosphate and tridecyl diphenyl phosphate.

16. A functional fluid composition as defined in claim 14, said polyalkylene glycol ethers being selected from the group consisting of the n-butyl methyl diether of polypropylene glycol, the monomethyl ether of polypropylene glycol, and the copolymer of ethylene oxide and propylene oxide, monobutyl ether.

17. A functional fluid composition as defined in claim 15, said polyalkylene glycol ethers being selected from the group consisting of the n-butyl methyl diether of polypropylene glycol, the monomethyl ether of polypropylene glycol, and the copolymer of ethylene oxide and propylene oxde, monobutyl ether.

18. A functional fluid composition as defined in claim 17, wherein both said one and said second polyalkylene glycol ethers are each a copolymer of ethylene oxide and propylene oxide, monobutyl ether.

19. A functional fluid composition as defined in claim 5, wherein $R_a$ in said epoxy compound is alkyl of from 1 to 10 carbon atoms and $R_b$ of said epoxy compound is alkylene, the alkylene group thereof containing from 2 to 4 carbon atoms, and n of said epoxy compound ranges from 1 to about 10.

20. A functional fluid composition as defined in claim 12, wherein $R_a$ in said epoxy compound is alkyl of from 1 to 10 carbon atoms and $R_b$ of said epoxy compound is alkylene, the alkylene group thereof containing from 2 to 4 carbon atoms, and n of said epoxy compound ranges from 1 to about 10.

21. A functional fluid composition as defined in claim 17, wherein $R_a$ in said epoxy compound is alkyl of from 1 to 10 carbon atoms and $R_b$ of said epoxy compound is alkylene, the alkylene group thereof containing from 2 to 4 carbon atoms, and n of said epoxy compound ranges from 1 to about 10.

22. A functional fluid composition as defined in claim 5, wherein said epoxy compound is employed in an amount ranging from about 2 to about 10%, by weight.

23. A functional fluid composition as defined in claim 19, wherein said epoxy compound is employed in an amount ranging from about 2 to about 10%, by weight.

24. A functional fluid composition as defined in claim 5, said epoxy compound being a poly(ethylene-$\Delta^4$-epoxy tetrahydrophthalate).

25. A functional fluid composition as defined in claim 12, said epoxy compound being a poly(ethylene-$\Delta^4$-epoxy tetrahydrophthalate).

26. A functional fluid composition as defined in claim 17, said epoxy compound being a poly(ethylene-$\Delta^4$-epoxy tetrahydrophthalate).

27. A functional fluid composition as defined in claim 1, wherein said polyepoxide has a molecular weight ranging from about 250 to about 10,000 and an epoxy equivalency ranging from about 200 to about 1,000.

28. A functional fluid composition as defined in claim 6, wherein n ranges from about 1 to about 8, said polyepoxide having a molecular weight ranging from about 500 to about 2,000, and having an epoxy equivalency ranging from about 250 to about 300.

29. A functional fluid composition as defined in claim 17, wherein n ranges from about 1 to about 8, said polyepoxide having a molecular weight ranging from about 500 to about 2,000, and having an epoxy equivalency ranging from about 250 to about 300.

30. In a method of operating a hydraulic pressure device wherein a displacing force is transmitted to a displaceable member by means of a hydraulic fluid, the improvement which comprises employing as said fluid a composition as defined in claim 1.

31. In a method of operating a hydraulic pressure device wherein a displacing force is transmitted to a displaceable member by means of a hydraulic fluid, the improvement which comprises employing as said fluid a composition as defined in claim 25.

* * * * *

UNITED STATES PATENT OFFICE

CERTIFICATE OF CORRECTION

Patent No. 3,984,340 Dated October 5, 1976

Inventor(s) Martin B. Sheratte

It is certified that error appears in the above-identified patent and that said Letters Patent are hereby corrected as shown below:

On the cover sheet, in the heading "Notice"

"Jan. 27, 1993" should read -- May 18, 1993 --.

Signed and Sealed this

Eleventh Day of January 1977

[SEAL]

*Attest:*

RUTH C. MASON
*Attesting Officer*

C. MARSHALL DANN
*Commissioner of Patents and Trademarks*